US006352023B1

(12) United States Patent
Dunaway

(10) Patent No.: US 6,352,023 B1
(45) Date of Patent: Mar. 5, 2002

(54) BINDERY COMPACTOR/BALER

(75) Inventor: Daniel Dunaway, Orinda, CA (US)

(73) Assignee: Wastestream, Orinda, CA (US)

( * ) Notice: Subject to any disclaimer, the term of this patent is extended or adjusted under 35 U.S.C. 154(b) by 0 days.

(21) Appl. No.: 09/593,271

(22) Filed: Jun. 13, 2000

Related U.S. Application Data

(63) Continuation-in-part of application No. 09/376,775, filed on Aug. 17, 1999, now Pat. No. 6,289,799.

(51) Int. Cl.[7] ..... B30B 15/30

(52) U.S. Cl. ..... 100/35; 100/49; 100/90; 100/215; 100/229 A; 55/429; 55/430

(58) Field of Search ..... 100/35, 49, 90, 100/100, 190, 208, 215, 229 A, 229 R; 55/429, 430

(56) References Cited

U.S. PATENT DOCUMENTS

| | | | | |
|---|---|---|---|---|
| 279,854 | A | | 6/1883 | Belt |
| 3,161,124 | A | | 12/1964 | Stromberg |
| 3,212,432 | A | * | 10/1965 | Raab ..... 100/215 X |
| 3,250,414 | A | | 5/1966 | Pioch |
| 3,610,139 | A | | 10/1971 | Bowles |
| 3,613,569 | A | | 10/1971 | Liberman et al. |
| 3,635,002 | A | * | 1/1972 | Ries ..... 100/215 X |
| 3,753,506 | A | | 8/1973 | Palmer et al. |
| 3,838,634 | A | * | 10/1974 | Alexandrov et al. .... 100/190 X |
| 3,948,167 | A | * | 4/1976 | De Feudis ..... 100/215 |
| 4,099,457 | A | * | 7/1978 | Hyden ..... 100/215 X |
| 4,289,068 | A | | 9/1981 | Heinrich |
| 4,464,987 | A | * | 8/1984 | Heinrich ..... 100/215 |
| 4,557,658 | A | | 12/1985 | Lutz |
| 5,001,978 | A | | 3/1991 | Discepolo |
| 5,415,086 | A | | 5/1995 | Robbins |
| 5,868,068 | A | * | 2/1999 | Lee |

FOREIGN PATENT DOCUMENTS

| | | | | |
|---|---|---|---|---|
| JP | 53-89277 A1 | * | 8/1978 | ..... 100/215 |

* cited by examiner

*Primary Examiner*—Stephen F. Gerrity
(74) *Attorney, Agent, or Firm*—Townsend and Townsend and Crew LLP

(57) ABSTRACT

A bindery compactor and/or baler receives and compacts or bales simultaneously large particulate paper waste and pneumatically conveyed fine paper waste. The compactor and/or baler operate with a platen cycling within a chute. The platen is normally forward in the compacting position with a sealing plate attached to the platen extending to close the top of the chute and form the bottom of two waste paper receiving bins. A first of these paper waste-receiving bins is for large particulate paper waste loaded from a cart dumper or conveyor. A second of these waste-receiving bins is for pneumatically transported fine paper waste from a cyclone separator. In both bins, accumulation of paper waste occurs to a height where an electric eye triggers cycling of the compactor only when a sufficient volume of material is present for compaction and an excess volume is present for preventing pneumatically induced escape of material. When cycling is triggered, the compactor platen retracts from extension to the chute withdrawing the sealing plate and allowing the stored paper waste from either bin to fall into the chute ahead of the retracting platen. Upon reaching full retraction, the platen reverses direction to compact all paper waste falling from either bin in the chute. In all cases, blowing by or escape of fine particles is prevented by remaining waste in either the bin receiving fine paper particles or the bin receiving the large paper particles.

9 Claims, 3 Drawing Sheets

BINDERY COMPACTOR/BALER

This Application is a continuation-in-part of U.S. patent application Ser. No. 09/376,775 filed Aug. 17, 1999 entitled Bindery Compactor (now U.S. Pat. No. 6,289,799).

This invention relates to a bindery compactor utilized for the compression of paper waste in a bindery. More particularly, a bindery compactor is disclosed in which both air conveyed fine paper waste particles and cart transported gross paper particles can be received and compacted into a receiver.

BACKGROUND OF THE INVENTION

Binderies produce paper waste in two gross categories. First, there is relatively large particulate paper waste, which paper waste results from printed paper pages being trimmed preparatory to stitching. Second, and after stitching has occurred, the bound pages are uneven. Trimming of the pages—usually with a machine known as a "three knife"—produces fine paper waste. Binderies produce a surprising tonnage of such waste, with "medium" size binderies producing from 30 to 80 tons of such waste per month.

In many small to medium size binderies, both the large paper waste and the fine paper waste are transported in carts for recycling. Thereafter, removal of the waste material from the bindery in an uncompressed format occurs by van. This results in an inordinate number of van transport trips, increasing the cost of the recycling effort.

In other bindery facilities, processing of the large paper waste and the fine paper waste occurs in a compactor at the bindery. Since this disclosure relates to compactors, a review of the compactor prior art is relevant.

Compactors are well known in the paper waste collection industry. A compactor usually charges a receiver. The receiver is a large closed container in the order of 7 feet high, 7 feet wide, and 22 feet in length. The receiver has an opening at one end in the order of 42 inches high by 60 inches wide.

The compactor includes a chute of corresponding dimension to the opening. This chute leads from the opening of the receiver, a distance away from the receiver. This chute is traversed by a 42 inch high by 60 inch wide platen powered by a hydraulic ram. This hydraulic ram powers the platen through the volume defined by the chute to compact material in the chute. Material to be compacted is placed in the chute. This material is crowded or compacted into the waste receiver.

The ram and platen are normally withdrawn from the chute. This defines a waste receiving volume between the waste receiver and platen. Waste material is dumped into this volume to be compacted until the volume is full. When the volume to be compacted is full, compaction of the filled volume of the chute occurs into the receiver. When fully charged with paper waste materials, the receiver can hold in the order of 9,000 to 13,000 pounds of paper waste for recycling.

It is known to have the volume to be compacted in front of the compactor platen monitored by an electric eye. When the volume to be compacted is full, the compactor cycles forward to crowd waste paper material into the receiver. Upon completion of the compacting, the ram retracts the platen to define an emptied volume to be compacted ahead of the platen. During cycling forward of the compactor platen, the volume that was the volume to be compacted is sealed by a sealing plate affixed to the top of the platen and trailing the platen. This sealing plate makes the dumping of material into the compactor behind the platen not possible when the platen of the compactor is cycling to compress material into the receiver.

As binderies increase in product volume, pneumatic transporting of fine waste particles becomes economically feasible. Unfortunately, pneumatic transport and the machines necessary to recycle the pneumatically transported fine paper waste particles are expensive. Typically, the fine paper waste particles are transported in pneumatic ducts. Transporting air pressures within the ducts are in the range of 18 inches of water. Transporting speeds in the ducts as high as 50 mph occur. The pneumatically transported paper waste materials are typically discharged at their destination through a cyclone separator to a baler exterior of the bindery facility. Balers used with such pneumatic systems are expensive, specialized pieces of equipment which compress and thereafter bind the waste. Only large bindery facilities can economically justify installation of balers.

In larger binderies, even where pneumatic transport is utilized, large paper waste is conveyed by cart to a conventional compactor and not a baler. Thus, the use of a single machine for the processing of both the large particulate waste particles and the small waste particles is not known.

The main reason that pneumatically handled paper waste fine particles and cart or conveyor transport large paper particles are not handled together is because of possible "blowing by" of the fines. Specifically, pneumatically transported fines here to fore have been separately handled.

SUMMARY OF THE INVENTION

A bindery compactor and/or baler receives and compacts or bales simultaneously large particulate paper waste and pneumatically conveyed fine paper waste. The compactor and/or baler operate with a platen cycling within a chute. The platen is normally forward in the compacting position with a sealing plate attached to the platen extending to close the top of the chute and folly the bottom of two waste paper receiving bins. A first of these paper waste-receiving bins is for large particulate paper waste loaded from a cart dumper or conveyor. A second of these waste-receiving bins is for pneumatically transported fine paper waste from a cyclone separator. In both bins, accumulation of paper waste occurs to a height where an electric eye triggers cycling of the compactor only when a sufficient volume of material is present for compaction and an excess volume is present for preventing pneumatically induced escape of material. When cycling is triggered, the compactor platen retracts from extension to the chute withdrawing the sealing plate and allowing the stored paper waste from either bin to fall into the chute ahead of the retracting platen. Upon reaching full retraction, the platen reverses direction to compact all paper waste falling from either bin in the chute. In all cases, blowing by or escape of fine particles is prevented by remaining waste in either the bin receiving fine paper particles or the bin receiving the large paper particles. An advantage of this apparatus and process is the ability to handle both pneumatically transported fine particulate paper waste and cart transported large particulate paper waste at the same baler or receiver. Specifically, when the platen is in the normally extended position, the bottom of both the bin for the fine particulate paper waste and the bottom of the bin for the large particulate paper waste is closed. This closure prevents residual air pressure from the cyclone separator (in the order of 2 inches of water) from blowing by particulate paper waste. When the platen is in the retracted position, either remaining material in the large particulate paper waste chute or remaining material in the fine particulate waste chute prevents the escape of the pneumatically transported fine paper waste. As a result, the same receiver compactor or baler can be used to handle both fine paper waste and large particulate paper waste.

A further advantage of this invention is that the bin for receiving the fine particulate paper waste is given a buffering volume, which buffering volume exceeds the volume to be compacted. As a consequence, when the platen is cycled for crowding of paper waste into the receiver, the residual volume of fine particulate paper waste dissipates any residual air pressure. Further, and where repeated cycling of the compactor empties the fine particulate bin, residual large particulate paper waste materials prevent the fines from blowing by the compactor receiver.

DESCRIPTION OF THE SPECIFIC EMBODIMENTS

Figure 1:
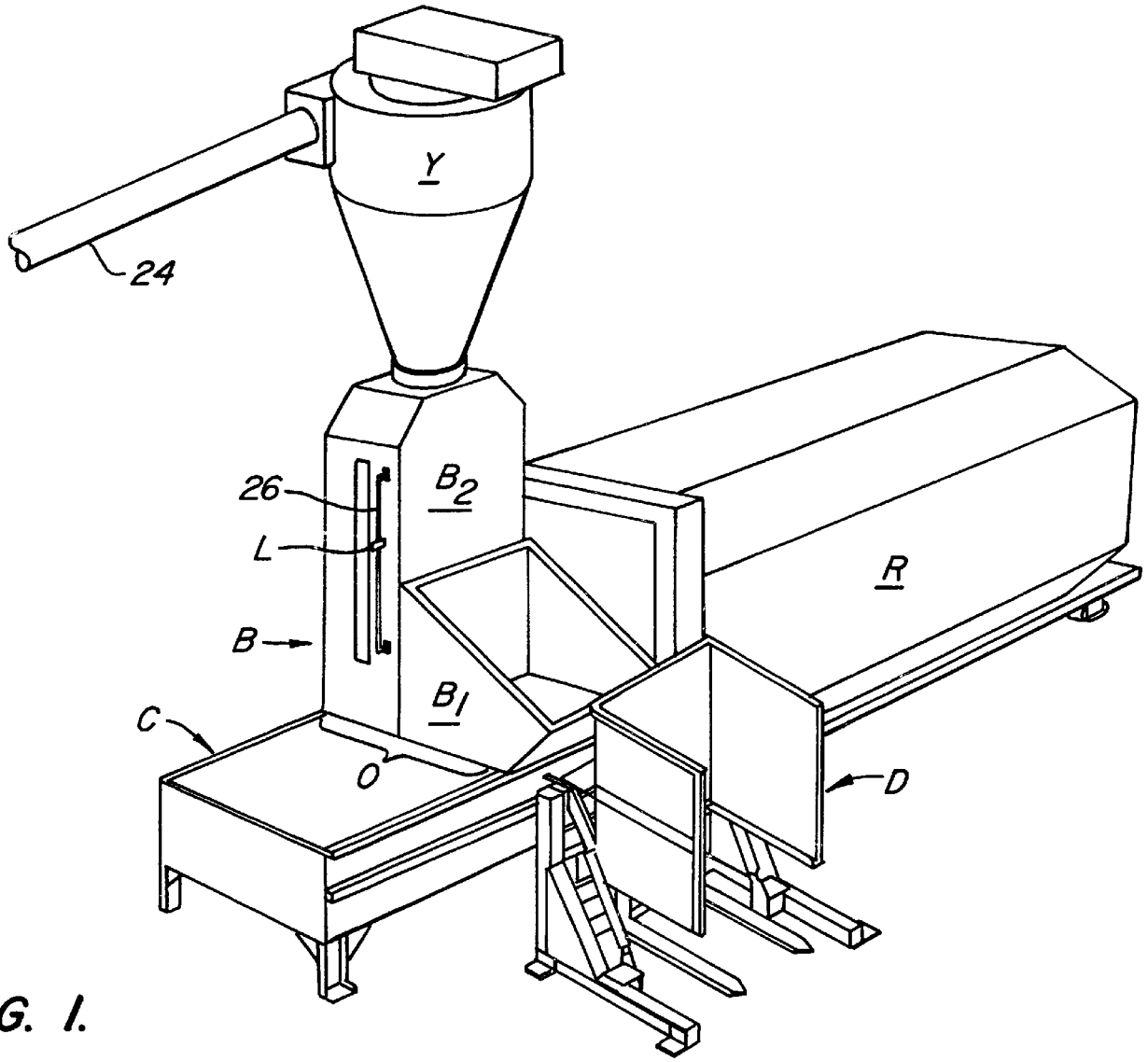
FIG. 1 is a perspective view of the bindery compactor according to this invention with two bins shown overlying the chute of a conventional bindery compactor having one of the chutes filled with pneumatically conveyed material received from a cyclone separator and the other of the chutes receiving waste material from a cart shown attached to a conventional cart dumper.

Referring to FIG. 1, receiver R is shown connected to compactor C. Compactor C has two major modifications, which make this disclosure possible. First, the cycle of compactor C is the reverse of that previously utilized. In the prior art, platen P is normally extended in the crowding disposition with respect to receiver R. Second, two buffering bins B have been built overlying compactor C. (See FIG. 2) These respective buffering bins B enable waste material to first be accumulated and thereafter periodically compacted.

In setting forth this disclosure, a convention compactor C will be described. Thereafter, the altered cycle of this invention will be set forth followed by a description of buffering bins B. Operation will briefly be set forth.

Referring to FIG. 1, chute T has opening O at top 14. Platen P is actuated by hydraulic ram H. Platen P has excursion from normally extended position 16 to retracted position 18.

There is a need in conventional compactors C to prevent material to be compacted from falling between hydraulic ram H and the back end of chute T. Accordingly, platen P has horizontal guard plate G closing opening O when platen P is in the forward position.

It is to be understood that compactor C essentially has a reverse cycle compared to compactors of the prior art. In the case of the normal compactor C, opening O is normally open. In the case of the compactor C utilized with this invention, opening O is usually closed. To prevent material from leaking by horizontal guard plate G, this plate is swept by wipers 20, 22.

Returning to FIG. 1, and remembering that opening O is normally closed, it will be seen that two buffering bins B are built overlying normally closed opening O. First, large particle buffering bin B, conventional cart dumper D attached and disposed to dump carts containing large paper particles into large particle buffering bin $B_1$. Thus, when sufficient large particles are accumulated in a bindery, dumping to compactor C can occur. This is the usual use of a compactor in a bindery.

Second, opening O has small particle buffering bin $B_2$ attached overlying normally closed opening O. Filling of this small particle buffering bin $B_2$ occurs from cyclone separator Y attached to duct 24 coming from the interior of a bindery (not shown).

Figure 2:
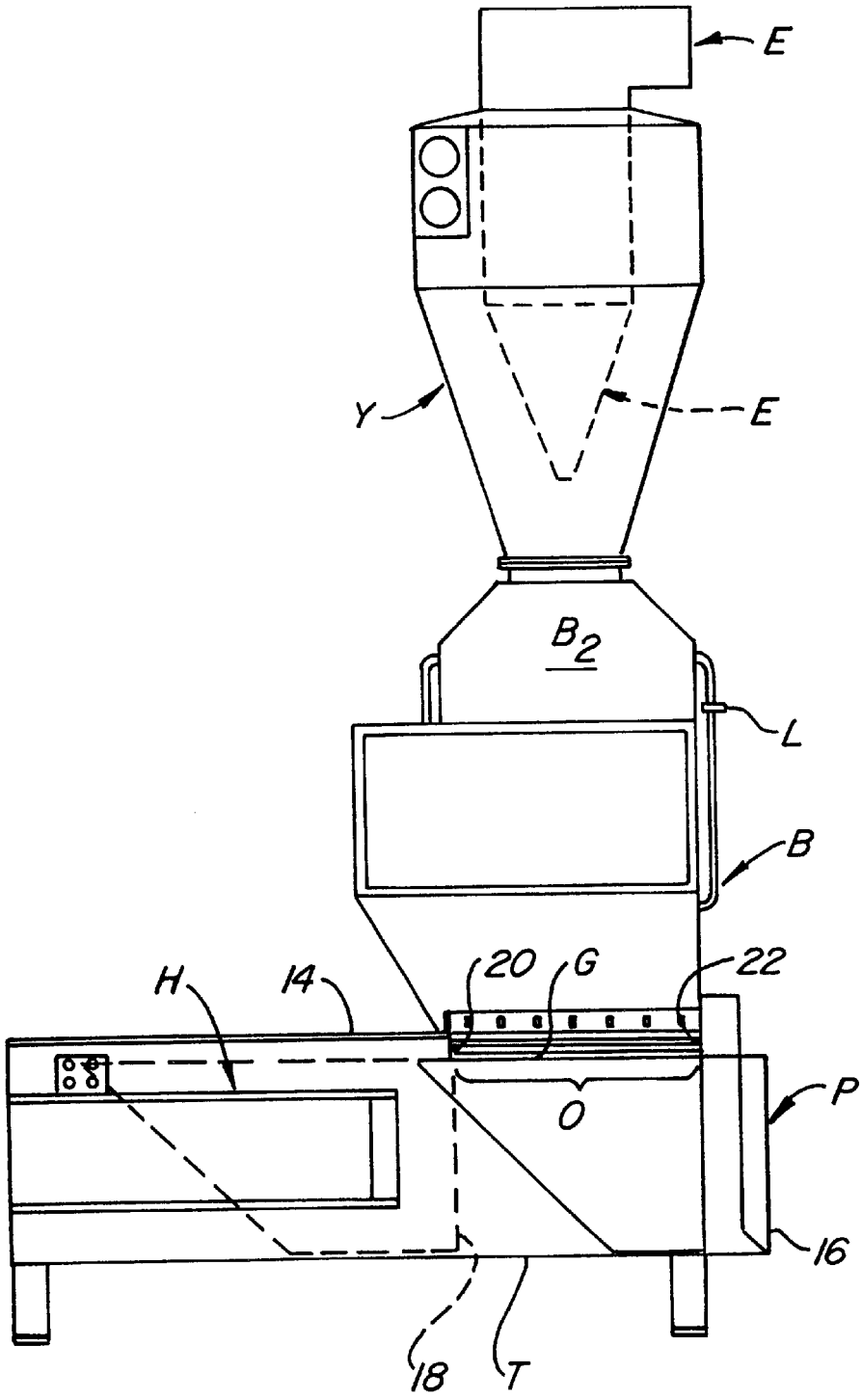
FIG. 2 is a side elevation of just the compactor, cart bin, and pneumatically conveyed paper waste bin utilized in this invention.

Referring to FIG. 2, cyclone separator Y is easy to understand. Typically, conventional vacuum inlets are employed interior of the bindery in the vicinity of the "three knife" cutter (not shown). These fine particles are conveyed under air pressure through duct 24 under air pressures in the range of 18 inches of water. Cyclone separator Y is made at a cone angle of about 22 from the vertical. In the interior it includes a complimentary perforate exhaust cone E. Assuming input pressure of 18 inches of water into cyclone separator Y, output of transported particulate small particulate waste occurs under about 2 inches of water pressure.

Ordinarily, discharge of particulate matter under 2 inches of water pressure could cause blow by of materials such as fine particulate paper waste. Here, however, factors prevent such blowing by.

First, small particle buffering bin $B_2$ is provided with electric eye L. Electric eye L slides on bracket 26 and is maintained at a height with respect to compactor C so that discharge from small particle buffering bin $B_2$ more than fills the volume ahead of platen P. Thus, at no time will small particle buffering bin $B_2$ be completely empty.

Second, platen P is normally closed. In the normally closed position, blowing by of fine particulate waste cannot occur.

Third, the only exit for material from compactor C, assuming that platen P is in the open position, is out though large particle buffering bin $B_1$.

It is at this juncture that the use of the side-by-side bins is important. Each bin is monitored by its own electric eye. When waste in either bin reaches the height of the electric eye, the platen cycles back, the waste falls into the defined crowding interval, and the platen cycles forward, causing closure of the bin bottoms. In the case of either bin, the volume retained in the bin exceeds to total volume compacted. Thus, there will always be a remain amount (or head) of waste material in at least one of the bins during cycling of the platen.

It is important to understand why this arrangement prevents "blow by" of the fine particles. First, presume that the flow of fines exceeds that of the large particulate paper. Cycling will always leave an accumulation of fines overlying the open crowding interval. Blowing by of the fines will not occur.

Second, presume that the flow of large particulate material exceeds that of the fine particulate paper. Cycling will leave an accumulation of large particulate material overlying the open crowding interval. Again blowing by of the fines will not occur because of the blockage of fines path by the accumulation or head of large particulate material.

It will be understood that the invention here set forth reverses the cycle of normal compactors. At the same time, by the adding of the large particle buffering bin $B_1$ and small particle buffering bin $B_2$, compactor C is converted into enabling one receiver R to transport away all materials from a bindery. Bales, balers, and separate bale transport is no longer required.

In the original application of this invention, applicability was applied to receivers. In the usual case of small and medium binderies, compactors were sufficient. We have found it surprising that there is a need for this apparatus with large binderies having large balers.

Figure 3B:
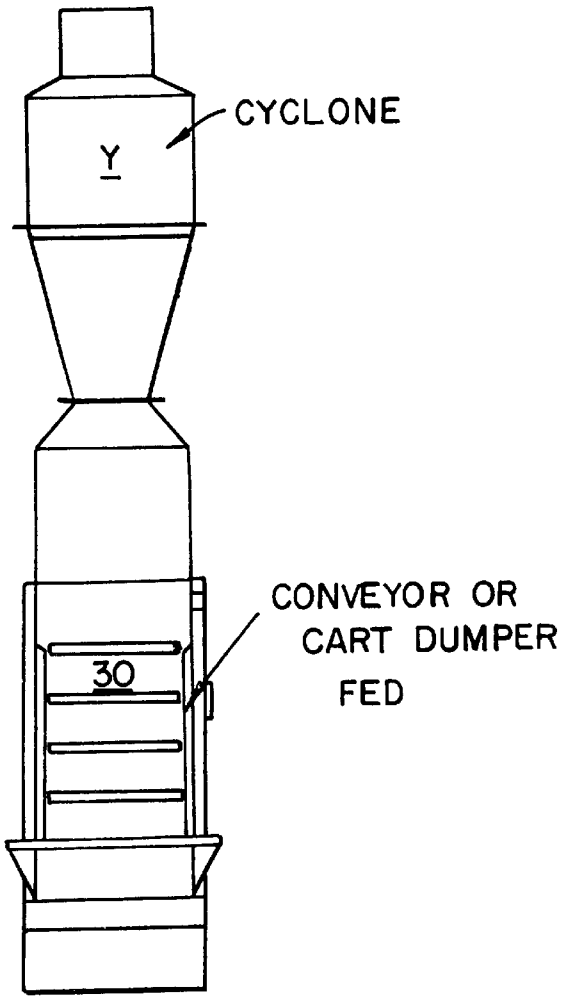
FIGS. 3A and 3B are respective side and end elevations of a conveyor for large particulate paper waste side-by-side with a bin receiving the discharge of pneumatically discharged fines from a cyclone separator with discharge occurring to a baler.
Figure 3A:
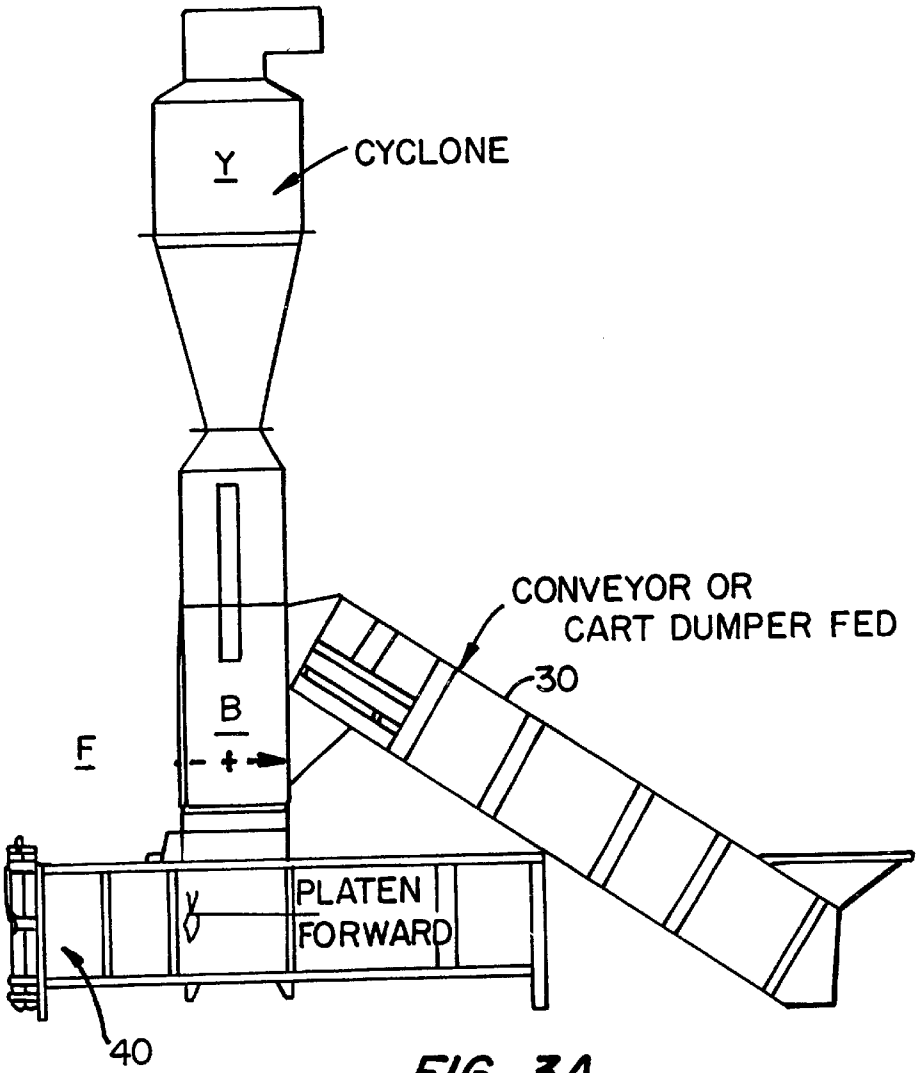

Accordingly, and in FIGS. 3A and 3B, cyclone separator Y is shown for the deposit of pneumatically conveyed particles. At the same time, conveyor 30 empties immediately below cyclone separator Y. Both conveyor 30 and cyclone separator Y charge the same buffering bin B.

This time, discharge from buffering bins B occurs to baler 40. As before, platen P charging baler 40 is actuated by electric eye L. It can therefore be understood that the apparatus here disclosed is operable with either compactors C or balers 40. Further, and as set forth in FIGS. 3A and 3B, discharge from either compactor C or baler 40 can occur to the same volume charging either the compactor or the baler.

What is claimed is:

1. In combination with a waste compaction device wherein the compaction device includes:

a receiver having an opening for receiving paper waste crowded into the opening;

a chute having a bottom, two parallel sides and an open top to receive waste material and extending from the opening of the receiver away from the receiver to define a volume to be compacted, the chute ending at the opening of the receiver;

a platen extending between the two parallel sides of the chute and moveable along the chute over the bottom of the chute for crowding material placed into the open top of the chute into the receiver;

an expandable ram fixed relative to the chute away from the opening of the receiver and expandable along the chute for moving the platen during crowding of the waste material from the chute into the receiver; and, a plate for sealing the open top of the chute behind the platen and over the expandable ram when the platen is moved forward along the chute to crowd material into the receiver;

an improvement to the compaction device comprising:

a first bin formed overlying the chute having a first bin bottom occupying less than a full area of the open top of the chute;

the first bin communicated to a pneumatic waste transport system;

a first electric eye for actuating the platen when the first bin is filled with material sufficient to permit compaction and to retain in the first bin a remainder of material;

a second bin formed overlying the chute having a second bin bottom occupying a remainder of an area of the open top of the chute;

the second bin communicated to a mechanical waste transport system;

a second electric eye for actuating the platen when the second bin is filled with material sufficient to permit compaction and retain in the second bin a remainder of material whereby upon retraction of the platen, the chute is opened to receive material from either the first bin or the second bin for crowding into the receiver there remains respectively in the second bin or the first bin a sufficient remainder of material to prevent pneumatically induced escape of waste material.

2. The combination with a compactor according to claim 1 and comprising in further combination:

the compaction device is a compactor and receiver.

3. The combination with a compactor according to claim 2 and comprising in further combination:

the compaction device is a compactor and baler.

4. The combination with a compactor according to claim 1 and comprising in further combination:

a cyclone separator for connection to a waste material pneumatic transport system; and, the output of the cyclone separator connected to the first bin.

5. The combination with a compactor according to claim 1 and comprising in further combination:

a cart dumper attached to the second bin for receiving a cart and dumping the contents of the cart to the bin.

6. A process of bindery compaction in a bindery with a compaction device wherein the compaction device includes:

a receiver having an opening for receiving paper waste crowded into the opening;

a chute having a bottom, two parallel sides and an open top to receive waste material and extending from the opening of the receiver away from the receiver to define a volume to be compacted, the chute ending at the opening of the receiver;

a platen extending between the two parallel sides of the chute and moveable along the chute over the bottom of the chute for crowding material placed into the open top of the chute into the receiver;

an expandable ram fixed relative to the chute away from the opening of the receiver and expandable along the chute for moving the platen during crowding of the waste material from the chute into the receiver; and, a plate for sealing the open top of the chute behind the platen and over the expandable ram when the platen is moved forward along the chute to crowd material into the receiver;

the process including the steps of:

providing a first bin formed overlying the chute having a first bin bottom occupying less than a full area of the open top of the chute;

providing a second bin formed overlying the chute having a second bin bottom occupying a remainder of an area of the open top of the chute;

maintaining the platen normally forward in the chute to close the opening of the receiver;

filling at least one of the bins with sufficient material to cause material to fall into the chute for compaction with a remaining volume in the chute to prevent pneumatically induced escape of waste material from the bin;

at least partially retracting the platen from the normally forward position to open the chute to receive material from either the first bin or the second bin for crowding into the receiver whereby the remaining volume in at least one of the bins prevents pneumatically induced escape of waste material from the bin; and, returning the platen to the normally forward position to crowd and compact material received in at least one of the bins into the receiver.

7. The process of bindery compaction according to claim 6 and further comprising:

the compaction device includes a receiver.

8. The process of bindery compaction according to claim 6 and further comprising:

the compaction device includes a baler.

9. The process of bindery compaction according to claim 6 and further comprising:

connecting one of the bins to an output of a cyclone separator; and, filling the bin with pneumatically separated waste material from the output of the cyclone separator.

* * * * *